US007779762B2

(12) United States Patent
Sackman

(10) Patent No.: US 7,779,762 B2
(45) Date of Patent: Aug. 24, 2010

(54) PORTABLE TOOL MANAGEMENT, STORAGE AND ORGANIZATIONAL SYSTEM FOR PAINTING AND WALLPAPERING

(76) Inventor: Stuart M. Sackman, 567 Ryders La., East Brunswick, NJ (US) 08816

( * ) Notice: Subject to any disclaimer, the term of this patent is extended or adjusted under 35 U.S.C. 154(b) by 1032 days.

(21) Appl. No.: 11/375,731

(22) Filed: Mar. 14, 2006

(65) Prior Publication Data

US 2006/0201397 A1 Sep. 14, 2006

Related U.S. Application Data

(60) Provisional application No. 60/661,324, filed on Mar. 14, 2005.

(51) Int. Cl.
*A47B 85/00* (2006.01)

(52) U.S. Cl. ..... 108/25; 108/35; 108/38

(58) Field of Classification Search ..... 108/24, 108/25, 26, 33, 34, 35, 36, 38, 41
See application file for complete search history.

(56) References Cited

U.S. PATENT DOCUMENTS

| | | | | |
|---|---|---|---|---|
| 223,828 | A | 1/1880 | Wiester | |
| 1,211,829 | A * | 1/1917 | Eades | 108/35 |
| 2,022,591 | A * | 11/1935 | Everitt | 108/24 |
| 2,406,237 | A * | 8/1946 | Milkoff | 108/35 |
| 2,683,639 | A * | 7/1954 | Brenny | 108/132 |
| 2,869,769 | A * | 1/1959 | Robinson | 206/227 |
| 3,394,666 | A | 7/1968 | Perlman | |
| D306,100 | S * | 2/1990 | Wende | 108/24 |
| 4,934,549 | A * | 6/1990 | Allen | 220/4.24 |
| 5,060,580 | A * | 10/1991 | Shaw | 108/25 |
| 5,115,893 | A * | 5/1992 | Terkildsen | 190/11 |
| 5,190,303 | A | 3/1993 | Schumacher | |
| 5,366,071 | A | 11/1994 | Lazlo | |
| 5,485,922 | A * | 1/1996 | Butcher | 206/576 |
| 5,556,181 | A * | 9/1996 | Bertrand | 108/25 |
| 6,012,696 | A | 1/2000 | Borie | |
| 6,062,357 | A * | 5/2000 | Bogert | 190/18 A |
| 6,161,486 | A | 12/2000 | Boots | |
| 6,164,212 | A | 12/2000 | Haggard | |
| 6,832,492 | B1 * | 12/2004 | Kunkel et al. | 62/458 |
| 7,055,442 | B2 * | 6/2006 | Podd et al. | 108/25 |

* cited by examiner

*Primary Examiner*—José V Chen

(57) ABSTRACT

The disclosure defines a portable tool management, storage and organizational system for painting and wallpapering which provides an apparatus and organization system for organizing painting and wallpapering tools and supplies. The disclosure further provides a combined painter's table (whose exterior covers provide work surfaces that are both configurable and adjustable) and carrying case that is collapsible and portable. The disclosure features a unique combination of features such as paint and water reservoirs with built-in drainage systems, and a wallpaper roll dispenser integrated into a collapsible and portable table surface that also features receptacles integrated into the table surface for holding painter's and wallpaperer's tools. The disclosure has both industrial and residential applications and is suitable for use by professional, semi-professional and non-professional painters and wallpaperers.

13 Claims, 14 Drawing Sheets

BOTTOM VIEW

PORTABLE TOOL MANAGEMENT, STORAGE AND ORGANIZATIONAL SYSTEM FOR PAINTING AND WALLPAPERING

CROSS-REFERENCE TO RELATED APPLICATION

This application claims priority to copending provisional application Ser. No. 60/661,324 filed Mar. 14, 2005.

FIELD OF INVENTION

The present invention relates to the field of painting and wallpapering.

BACKGROUND OF THE INVENTION

The tasks of painting and wallpapering involve the use of a plurality of painting and wallpapering tools and supplies, including without limitation, paint and paint reservoirs, water and water reservoirs, wallpaper, rags, paint brushes, caulk, screwdrivers, pencils, hammers, wood putty, spackle, nails, paint stirrers, sanding pads, seam rollers, utility knives, scrapers, razor blades, masking tape, drop cloths, painter's edge, tape measures, wallpaper cutter blades and cutter straight edge, and other miscellaneous tools and supplies. In an attempt to quickly locate tools and supplies needed for a given task, the individuals who perform these tasks (e.g., professional, semi-professional and non-professional painters and wallpaper hangers) typically use a plurality of tool management devices such as tool boxes, tool belts, paint roller pans, and other devices known to those skilled in the art of painting and wallpapering.

However, despite the existence and widespread use of such tool management devices, much time and effort is wasted by painters and wallpaper hangers when tracking the whereabouts of such tools and supplies, especially if such painters and wallpaper hangers employ a multitude of discrete tool management devices. Therefore, a need exists for an apparatus that provides an efficient storage and organizational system, allowing painters and wallpaper hangers to consolidate and more easily organize, store, manage, access and transport their painting and wallpapering tools and supplies.

BRIEF SUMMARY OF THE INVENTION

The above problems can be overcome, and advancement made in the art, by providing an apparatus and an easier method for consolidating and locating all the tools and supplies necessary for performing painting and wallpapering tasks without misplacing or searching for such tools and supplies. By consolidating such tools and supplies, an efficient storage and organization system is provided and greater efficiency can be realized by painters and wallpaper hangers through the use of such system.

DETAILED DESCRIPTION OF THE INVENTION

Figure 1:
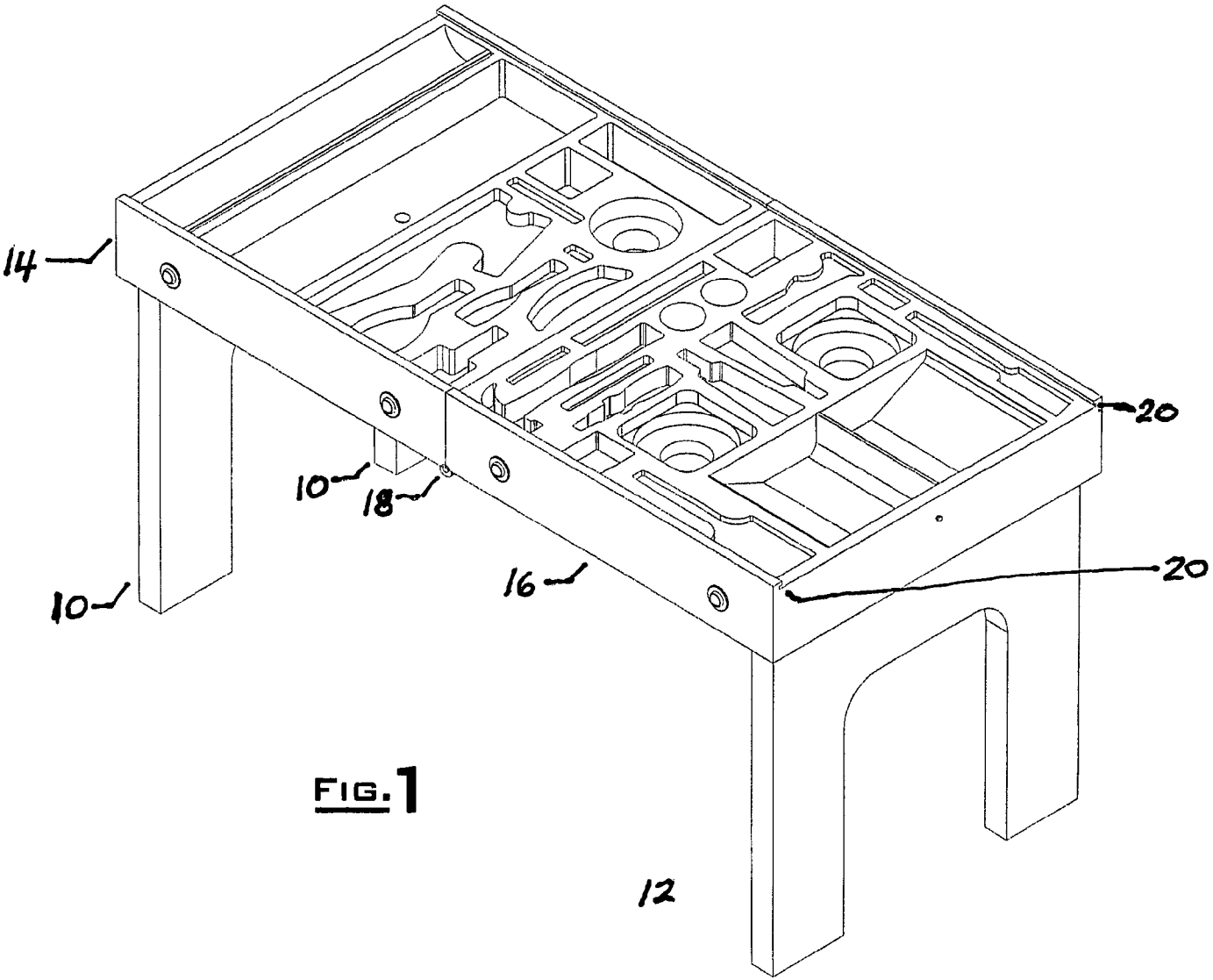
FIG. 1 through FIG. 19 detail a portable tool management, storage and organizational system for painting and wallpapering from various perspectives, in various positions and configurations, in accordance with an exemplary embodiment of the present invention.

The present invention can be better understood with reference to FIGS. 1 through 13. FIG. 1 is a view illustrating a portable tool management, storage and organizational system for painting and wallpapering in an unfolded position in accordance with the preferred embodiment of the present invention. But it should also be understood that the scope of this invention also applies to other embodiments. The components of the portable tool management, storage and organizational system for painting and wallpapering may be manufactured of any suitable material such as molded plastic resin, wood, metal, etc as will occur to those skilled in the art.

Referring to FIG. 1, a portable tool management, storage and organizational system for painting and wallpapering is shown in an open, upright position with retractable leg pairs 10 and 12 in their fully extended position. Leg pairs 10 and 12 may be manufactured of any suitable material such as molded plastic resin, wood, metal, etc as will occur to those skilled in the art. Leg pair 10 is hingedly connected in a manner known to one skilled in the art by any suitable hinge mechanism such as a pin (not shown) to a first main body unit 14 (also known as first main body member, as discussed in the claims below). Leg pair 12 is hingedly connected in a manner known to one skilled in the art by any suitable hinge mechanism such as a pin (not shown) to a second main body unit 16 (also known as second main body member, as discussed in the claims below). First main body unit 14 and a second main body unit 16 are pivotally connected together by a hinge 18, such that the connected first and second main body units form a continuous table top with various receptacles for holding tools, supplies and a cleaning system tray (tray shown in FIG. 10*a*), as more fully disclosed in the details of FIG. 12 below when the painter's table is in the first, open position, as shown in FIG. 1. Two cover-channel furrows 20, which are preferably in registry with one another for reasons to be pointed out below, are defined by raised walls of the two main body units 14 and 16, inwardly face each other and form a continuous cover-channel extending the entire length of the painter's table when the two main body units 14 and 16 are unfolded so that their hinged sides butt up against one another, end-to-end, and form a continuous table top.

Figure 2:
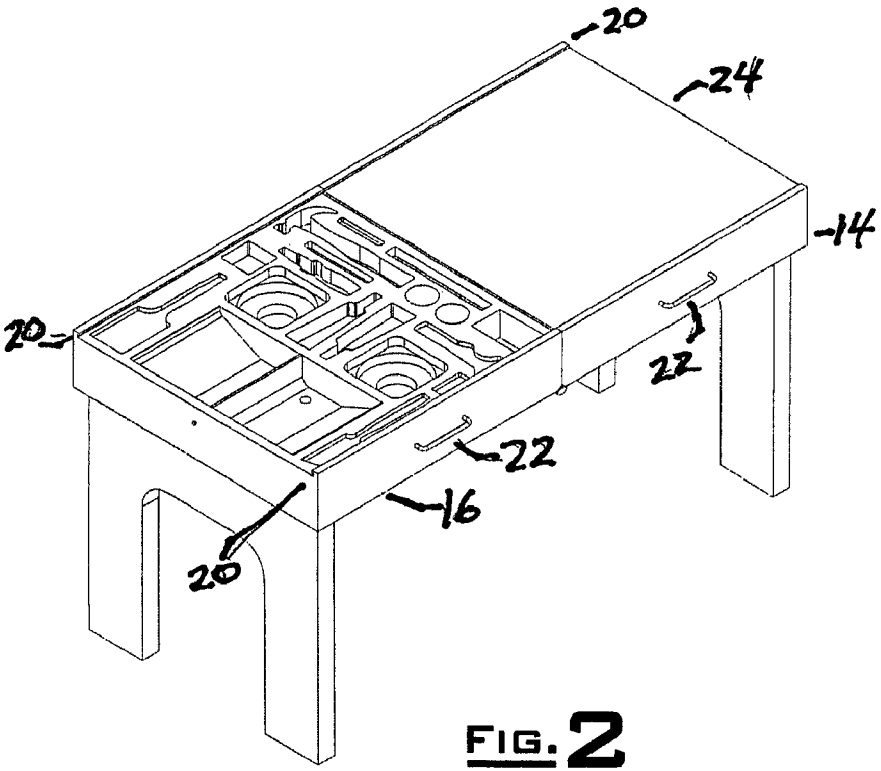

Referring to FIG. 2, the unfolded portable tool management, storage and organizational system for painting and wallpapering is portrayed from a visual perspective 180 degrees out of phase from the perspective of FIG. 1, revealing two carrying case handles 22, mounted to the two main body units 14 and 16. FIG. 2 also features one of two covers 24 slidably and removably inserted into the cover-channel furrows 20 of main body unit 14.

Figure 3:
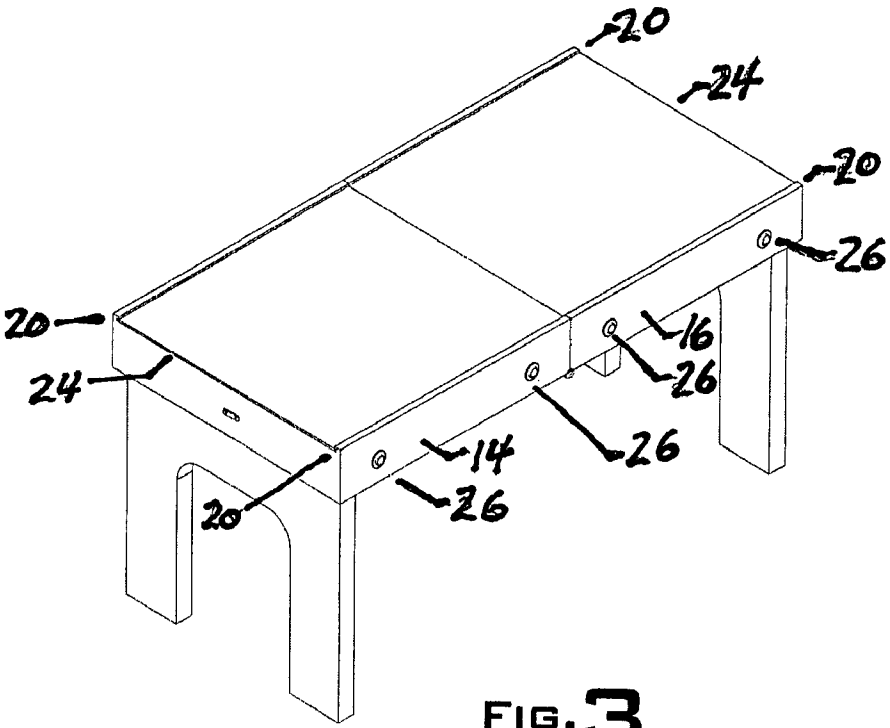

Referring to FIG. 3, the unfolded portable tool management, storage and organizational system for painting and wallpapering is portrayed from a visual perspective 90 degrees out of phase from the perspective of FIG. 1, revealing four ball casters 26, mounted to the two main body units 14 and 16 on the sides of the two main body unit pieces 14 and 16 that are opposite of the sides where the two handles are mounted. FIG. 2 features one cover 24 inserted into each of the cover-channel furrows 20 of main body units 14 and 16.

Figure 4:
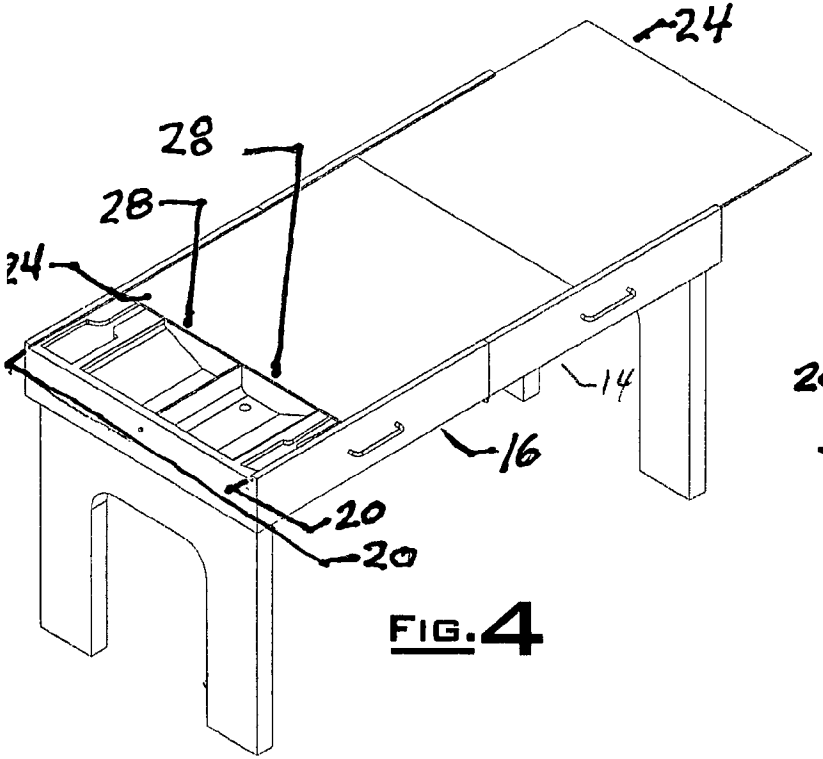

Referring to FIG. 4, the unfolded portable tool management, storage and organizational system for painting and wallpapering is portrayed from a visual perspective 180 degrees out of phase from the perspective of FIG. 1, revealing two covers 24 slidably and removably inserted into the cover-channel furrows 20 of main body units 14 and 16. As shown in FIG. 4, said covers can be slidably positioned to create an extendable work surface, to allow access to the receptacles where paint reservoirs 28 and various supplies and tools may be stored and accessed. Configurations of covers 24 include any configuration of one or more of the covers 24 attainable by sliding the covers 24 anywhere along the cover-channel furrows 20 in any combination of cover positions, including without limitation a dual-deck work surface configuration where the covers cover the reservoirs 28, and 30 and extend out on either side of the main body units 14 and 16 (not shown). Although the FIG. 4 shows the paint reservoir 28 in its molded dual paint reservoir configuration, the invention includes two other versions (not shown), a version with a single paint reservoir and multi-compartmental reservoir version where the compartments are created by inserting dividers into the single reservoir version in a manner known to one skilled in the art of divided tray design and manufacture.

Figure 5:
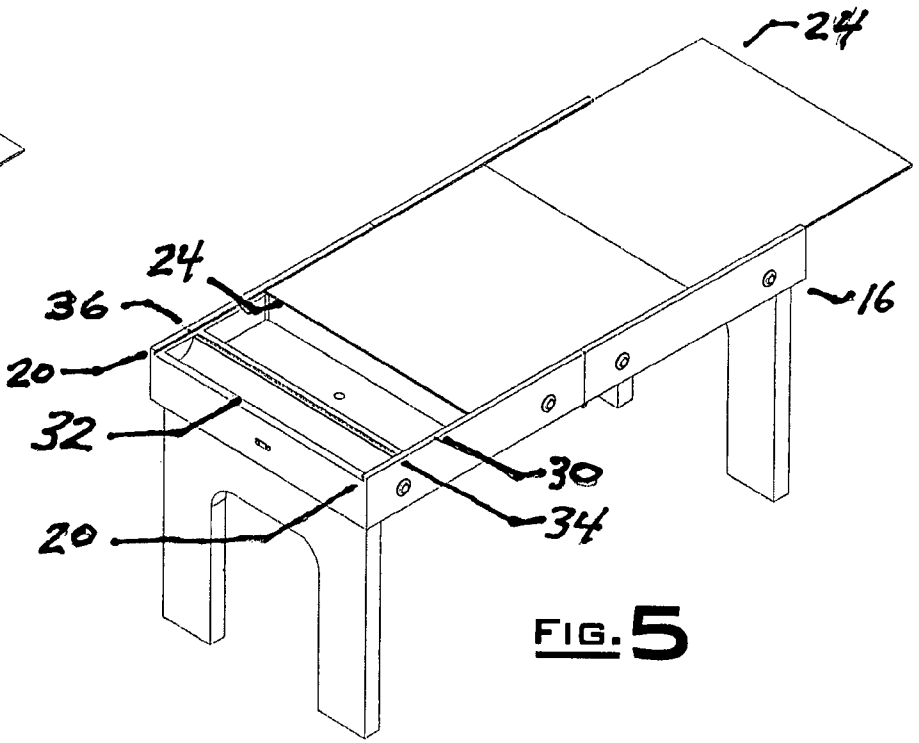

Referring to FIG. 5, the unfolded portable tool management, storage and organizational system for painting and wallpapering is portrayed from a visual perspective 90 degrees out of phase from the perspective of FIG. 1, revealing two covers 24 slidably and removably inserted into the cover-channel furrows 20 of main body units 14 and 16. As shown in FIG. 4, said covers can be slidably positioned to create an extendable work surface, to allow access to the receptacles where water reservoir 30, wallpaper dispenser 32, aluminum straight cutting edge 34 and blade groove 36 may be accessed. Details of water reservoir 30, wallpaper dispenser 32, aluminum straight cutting edge 34 and blade groove 36 are portrayed in FIG. 12 and discussed below.

Figure 6:
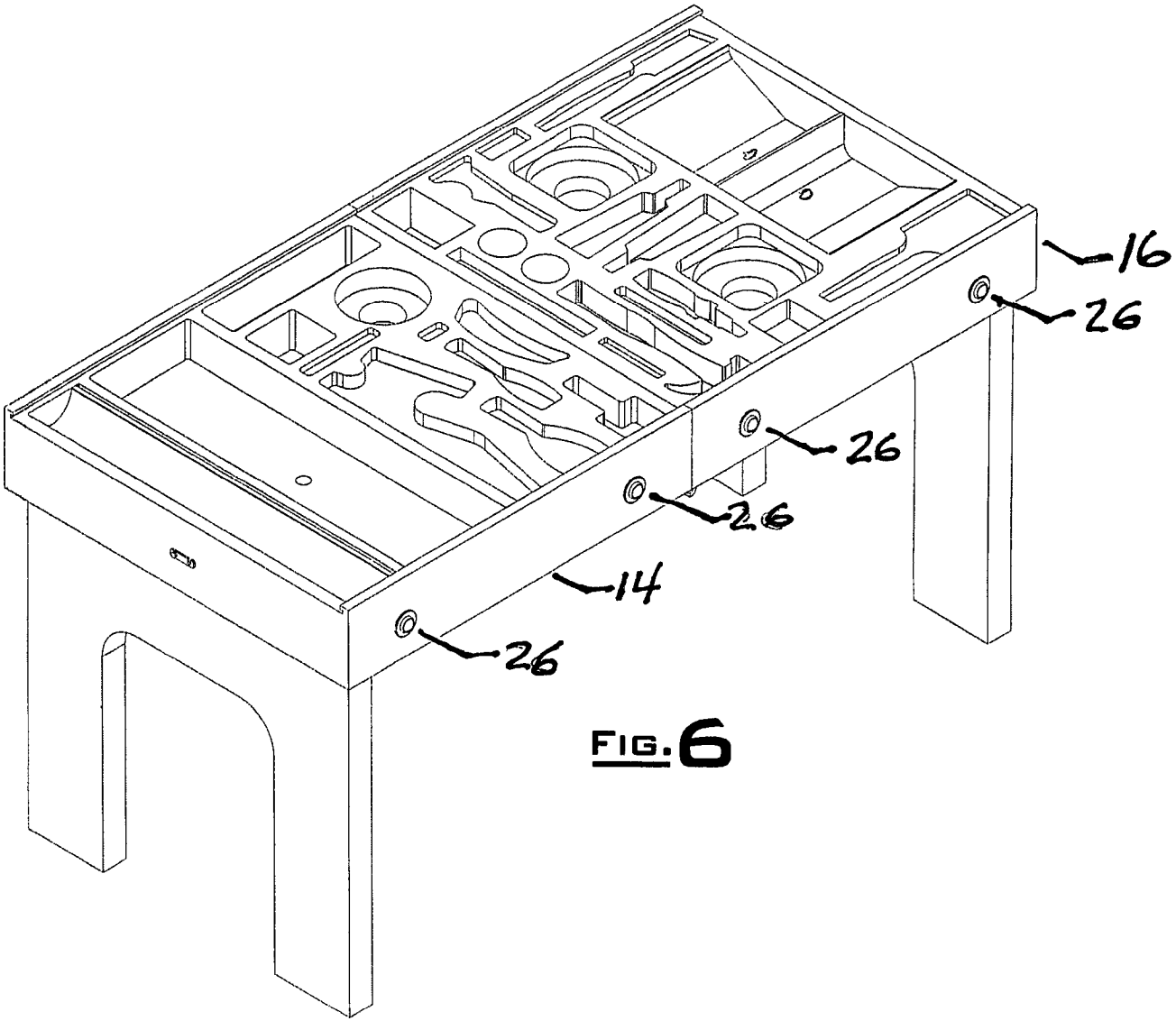

Referring to FIG. 6, the unfolded portable tool management, storage and organizational system for painting and wallpapering is portrayed from a visual perspective 90 degrees out of phase from the perspective of FIG. 1, revealing four ball casters 26, mounted to the two main body units 14 and 16 on the sides of the two main body unit pieces 14 and 16 that are opposite of the sides where the two handles 22 are mounted.

Figure 7:
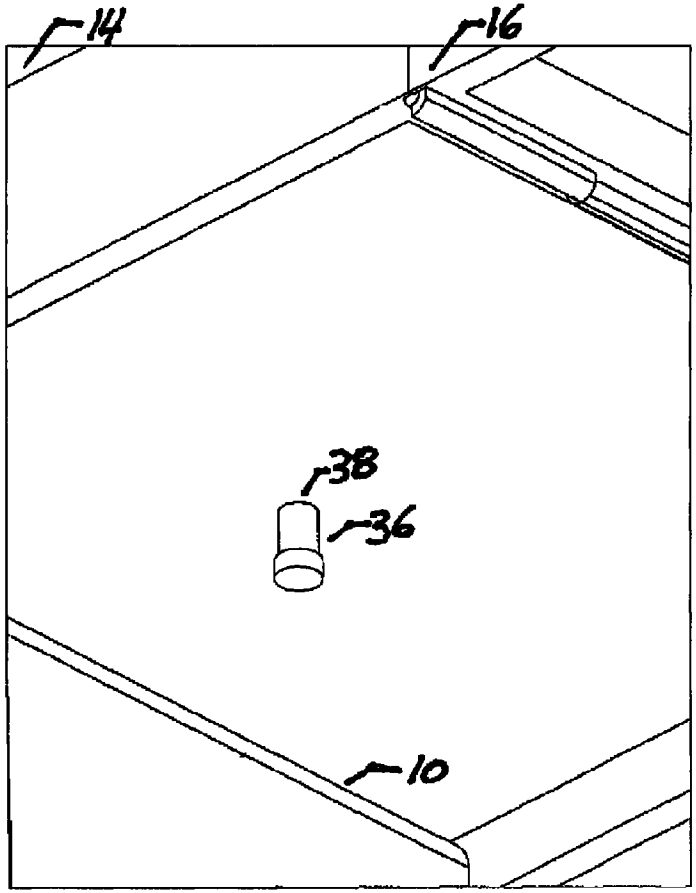
Figure 12:
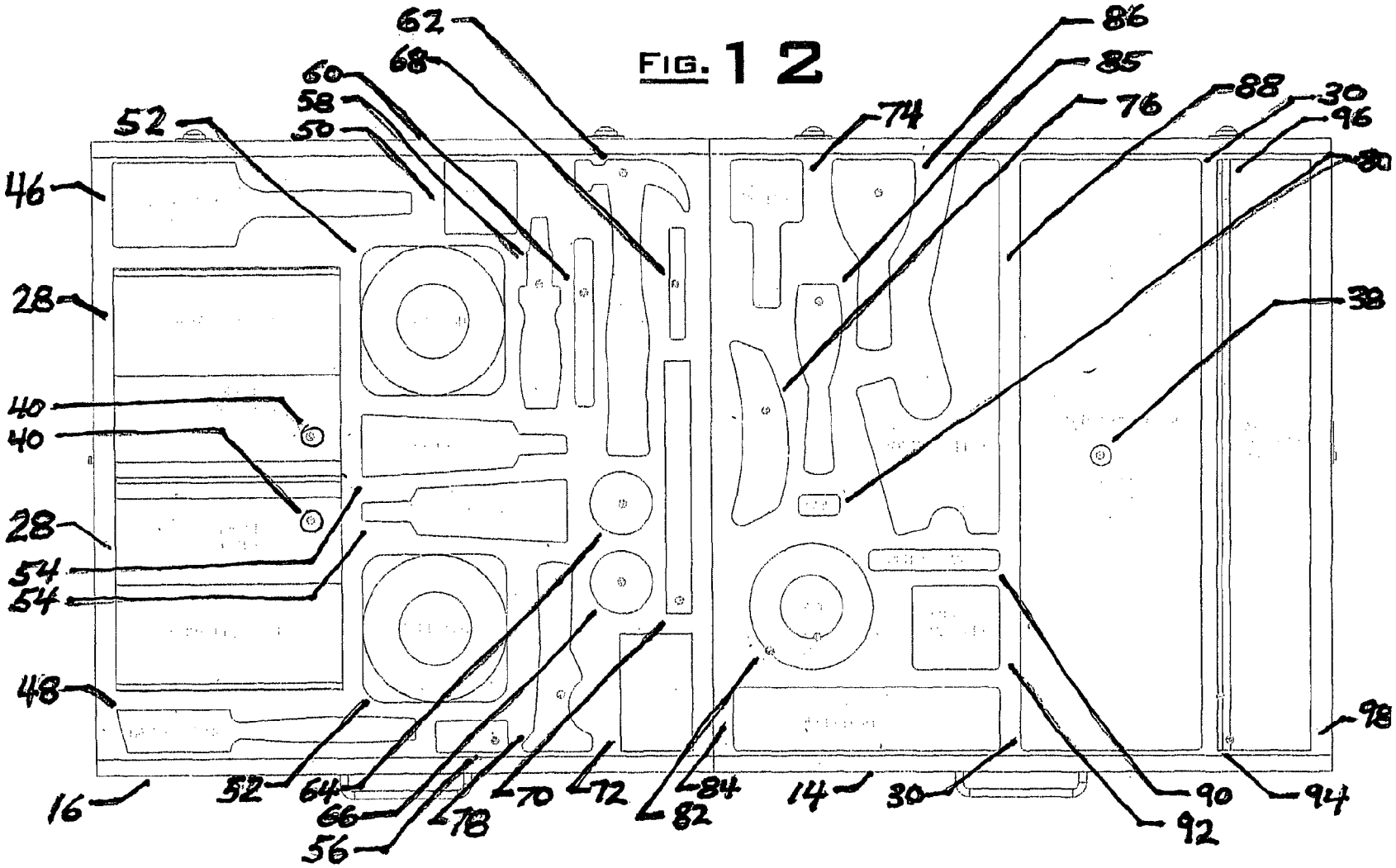

Referring to FIG. 7, the underside of main body unit 14 is shown and portrays a water reservoir drain plug 36 inserted into a water reservoir drain hole 38 for draining water from the water reservoir 30 (the water reservoir is shown in FIGS. 4 and 12).

Figure 8:
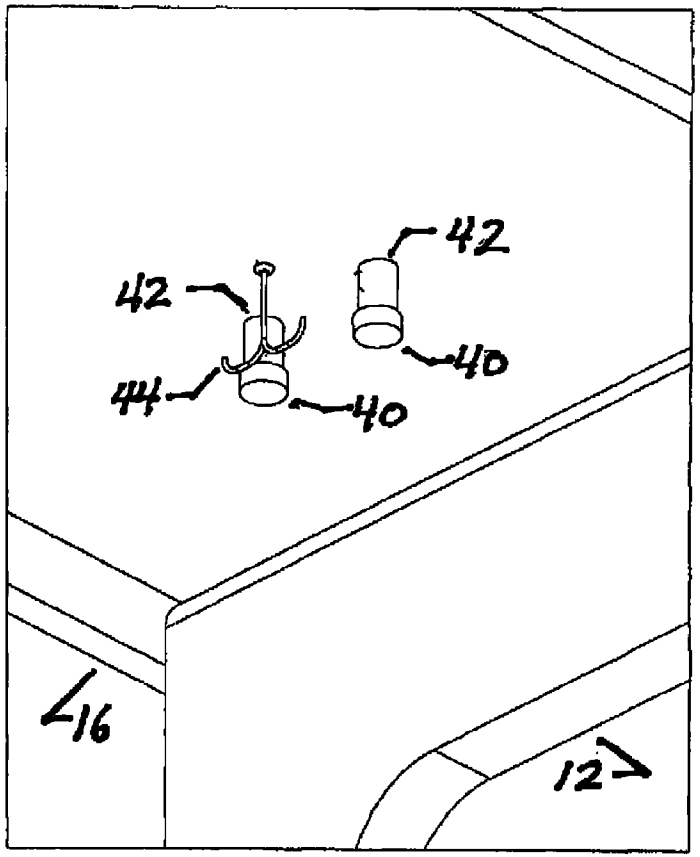

Referring to FIG. 8, the underside of main body unit 16 is shown and portrays two paint reservoir drain plugs 40 inserted into two paint reservoir drain holes 42 for draining paint from the paint reservoirs 28 (the paint reservoirs are shown in FIG. 4). Also shown in FIG. 8 is double-hook 44 which is used for hanging one or more paint cans below the paint reservoir drain holes 42 while paint is draining from the paint reservoirs 28.

Figure 9:
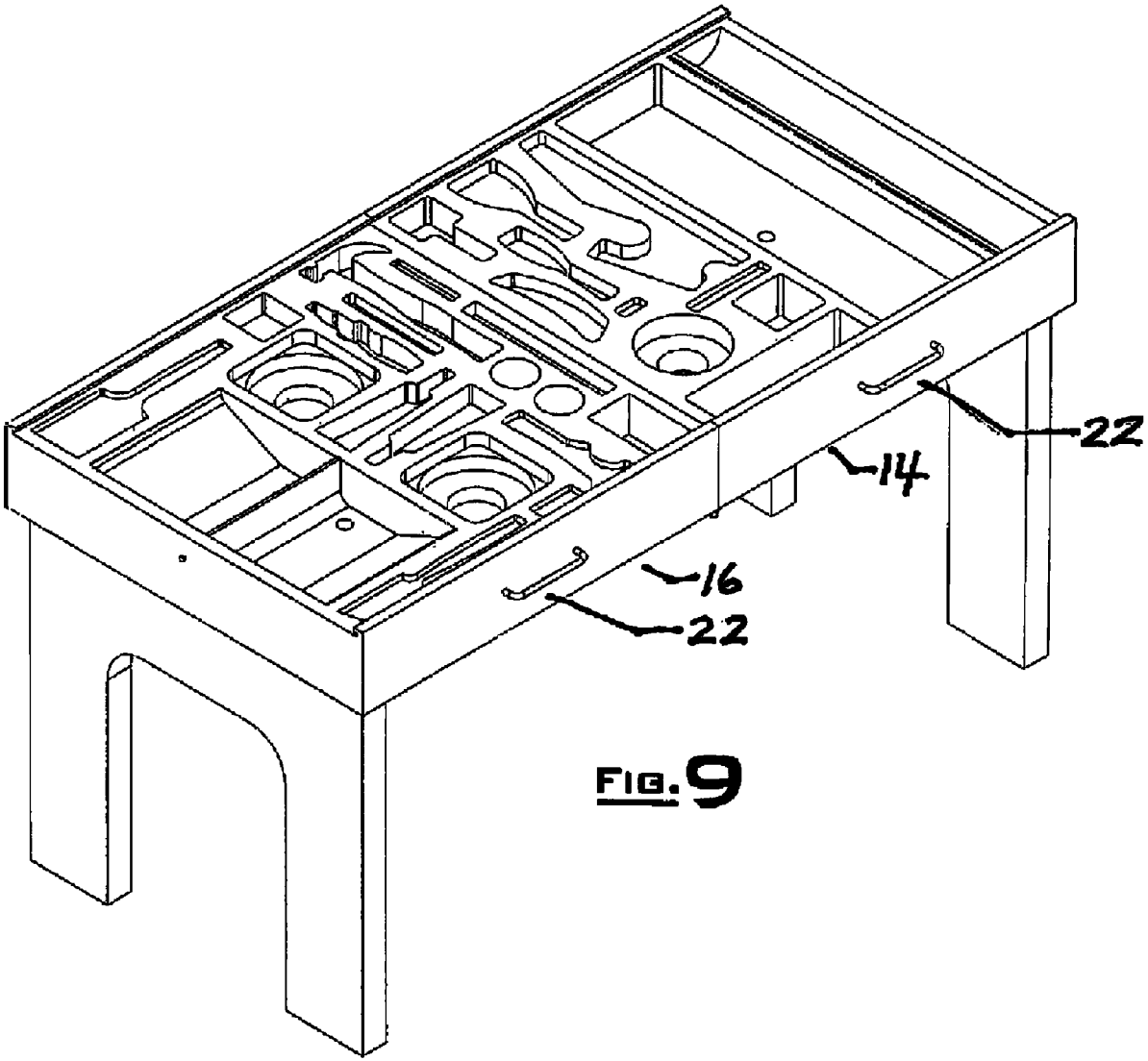

Referring to FIG. 9, FIG. 9 is similar to FIG. 2, but with both covers 24 omitted in order to more fully portray the receptacles of main body units 14 and 16, the unfolded portable tool management, storage and organizational system for painting and wallpapering is portrayed from a visual perspective 180 degrees out of phase from the perspective of FIG. 1, revealing two carrying case handles 22, mounted to the two main body units 14 and 16.

Figures 10, 10A:
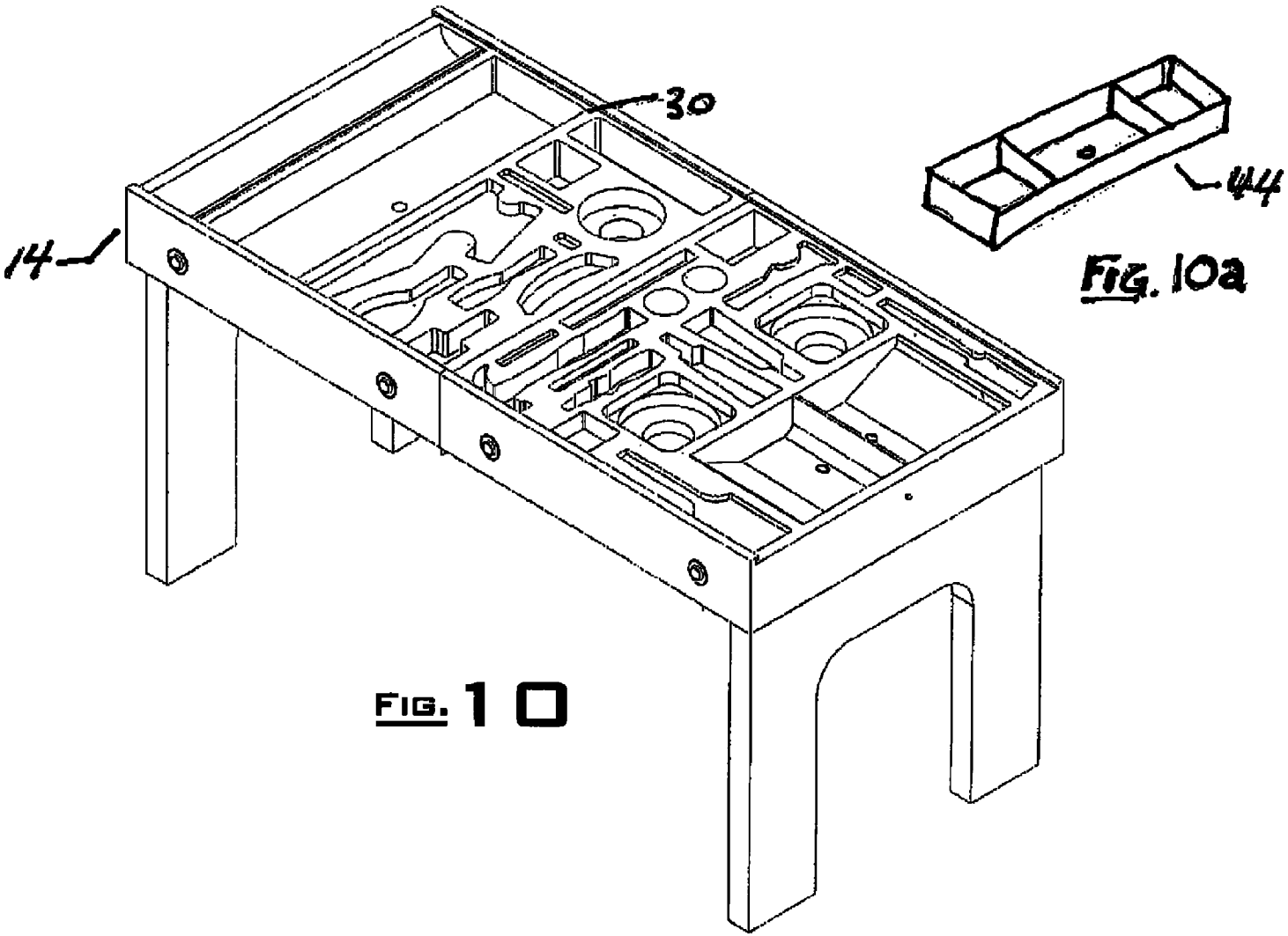

Referring to FIG. 10 and FIG. 10*a*, FIG. 10 is a reproduction of FIG. 1 portrayed in association with FIG. 10*a* to show the interrelationship of a cleaning system tray 44 to the reservoir 30 receptacle in main body unit 14, into which the tray 44 is inserted. Cleaning system tray 44 is divided into three compartments, one reservoir compartment occupying 50% of the tray space for use with cleaning water, solutions or solvents and the other two compartments each occupying 25% of the tray space for use with clean and dirty rags. Although not shown in FIG. 10*a*, the invention also includes an optional version of tray 44 that has a lid hingedly connected to tray 44, connected in a manner known to one skilled in the art.

Figure 11:
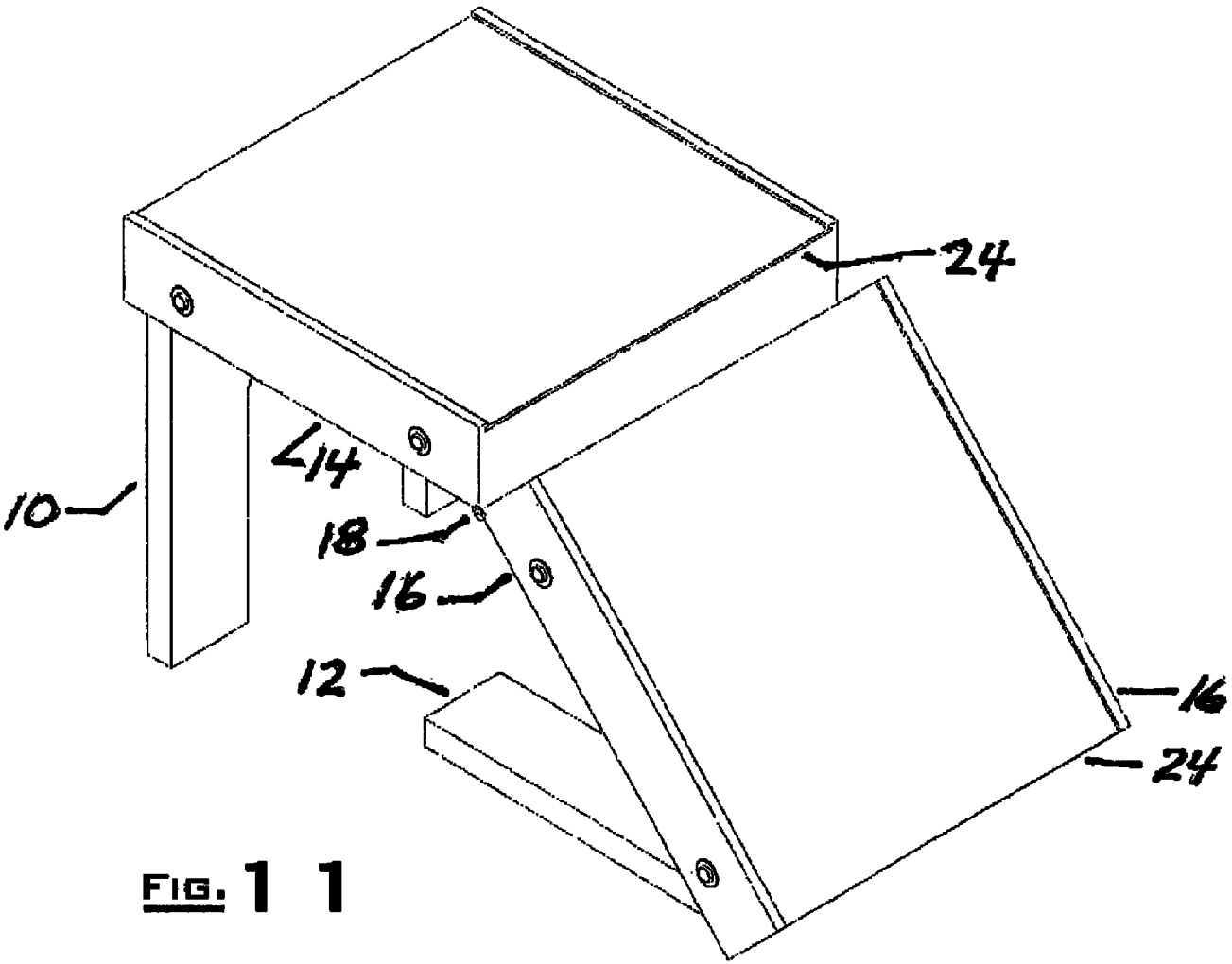

Referring to FIG. 11, FIG. 11 demonstrates the pivotal relationship between main body units 14 and 16 with the pivotal axis coinciding with hinge 18. FIG. 11 further demonstrates the pivotal relationship between main body unit 16 and leg pair 12. Although not shown in any of the figures, a substantially similar pivotal relationship exists between main body unit 14 and leg pair 10. It is due to these pivotal relationships that the portable tool management, storage and organizational system for painting and wallpapering is reconfigured from an open fully extended painters work table to a fully retracted carrying case, wherein the two leg pairs 10 and 12 are fully retracted into a cavernous underside of main body units 14 and 16, respectively and then the main body units 14 and 16 are closed together to form a closed carrying case, ready for transport or storage.

Referring to FIG. 12, in accordance with the preferred embodiment of the invention, FIG. 12 is a top view of an uncovered, open and fully extended painter's table which provides a layout and details of the following receptacles formed in the plastic resin molded main body units 14 and 16:

two paint reservoirs 28;
two paint reservoirs drain holes 40;
water reservoir 30;
water reservoir drain hole 38;
four-inch brush receptacle 46;
two-inch brush receptacle 48;
miscellaneous receptacle 50;
two paint can receptacles 52;
two caulk tube receptacles 54;
miscellaneous receptacle 56;
combination screwdriver receptacle 58;
pencil receptacle 60
hammer receptacle 62;
wood putty receptacle 64;
spackle receptacle 66;
nail set receptacle 68;
paint stirrers receptacle 70;
sanding pad receptacle 72;
seam roller receptacle 74;
utility knife receptacle 76;
five-in-one scraper receptacle 78;
razor blade receptacle 80;
tape receptacle 82;
drop cloths receptacle 84;
one-inch putty knife receptacle 85;
three-inch putty knife receptacle 86;
painter's edge receptacle 88;
pencil and miscellaneous receptacle 90;
tape measure receptacle 92;
wallpaper cutter blade groove 94;
wallpaper cutter aluminum straight edge 96;
wallpaper roll dispenser receptacle 98.

The two paint can receptacles 52 function as three-in-one (i.e., three-tiered) paint can receptacles which feature: (1) a substantially square recession in the receptacle with rounded corners of sufficient dimensions to accommodate the footprint of a square one gallon paint can, a rounded footprints; (2) a round one gallon can recession (recessed to a depth below the square recession for the one gallon square can footprint); and a round quart can recession (recessed to a depth below the round recession for the one gallon round can footprint). All center point of all three recessed footprint patterns are coincident in the paint can receptacle 52. However, the depth of three footprint recessions varies progressively amongst the three footprints with the substantially square one gallon can footprint having the shallowest depth relative to the other to cans, the one quart can foot print have the deepest recession depth, with the round one gallon can footprint recession depth lying somewhere between the square gallon and round quart recession depths.

The receptacle 82 features a raised spindle column in the center of the receptacle for centering and securing a painters tape role within the receptacle.

The preferred embodiment, including without limitation the layout and types of tools and or tool and supply receptacles portrayed in FIG. 12, is not an exhaustive representation of the invention. The invention more broadly encompasses and includes other tool and supply receptacle types and layouts in other embodiments. The invention also more broadly encompasses and includes other management and organizational systems (e.g., other carrying case, table and work surface cover configurations integrated strategically in combination with one another, including without limitation arranging the covers 24 to form a slidable dual wing-deck work surfaces configuration and other configurations and direct integration of tools (such as wallpaper roll cutters) that are useful towards improving painters' and wallpaperers' efficiency).

Figure 13:
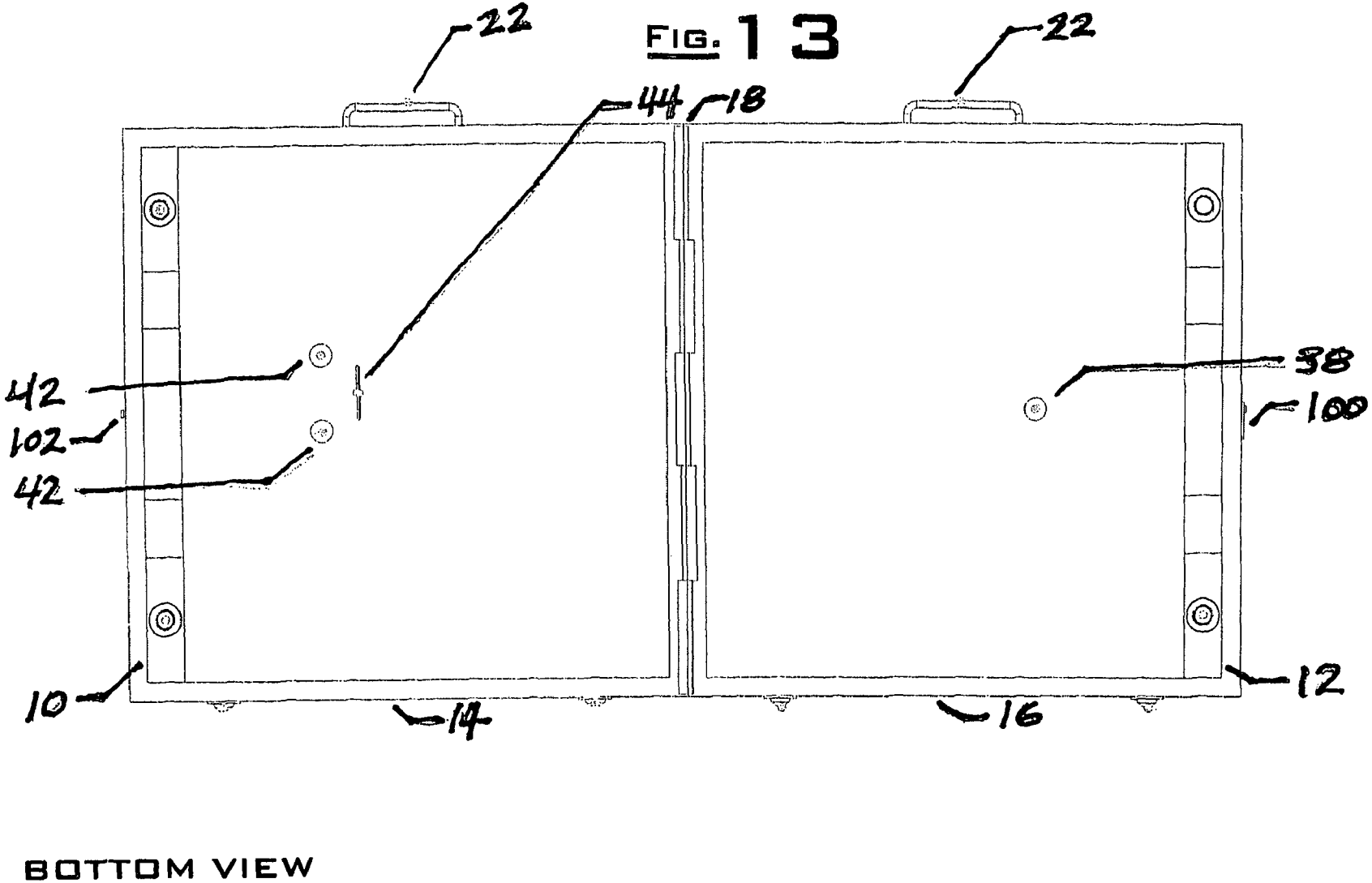
Figure 13A:
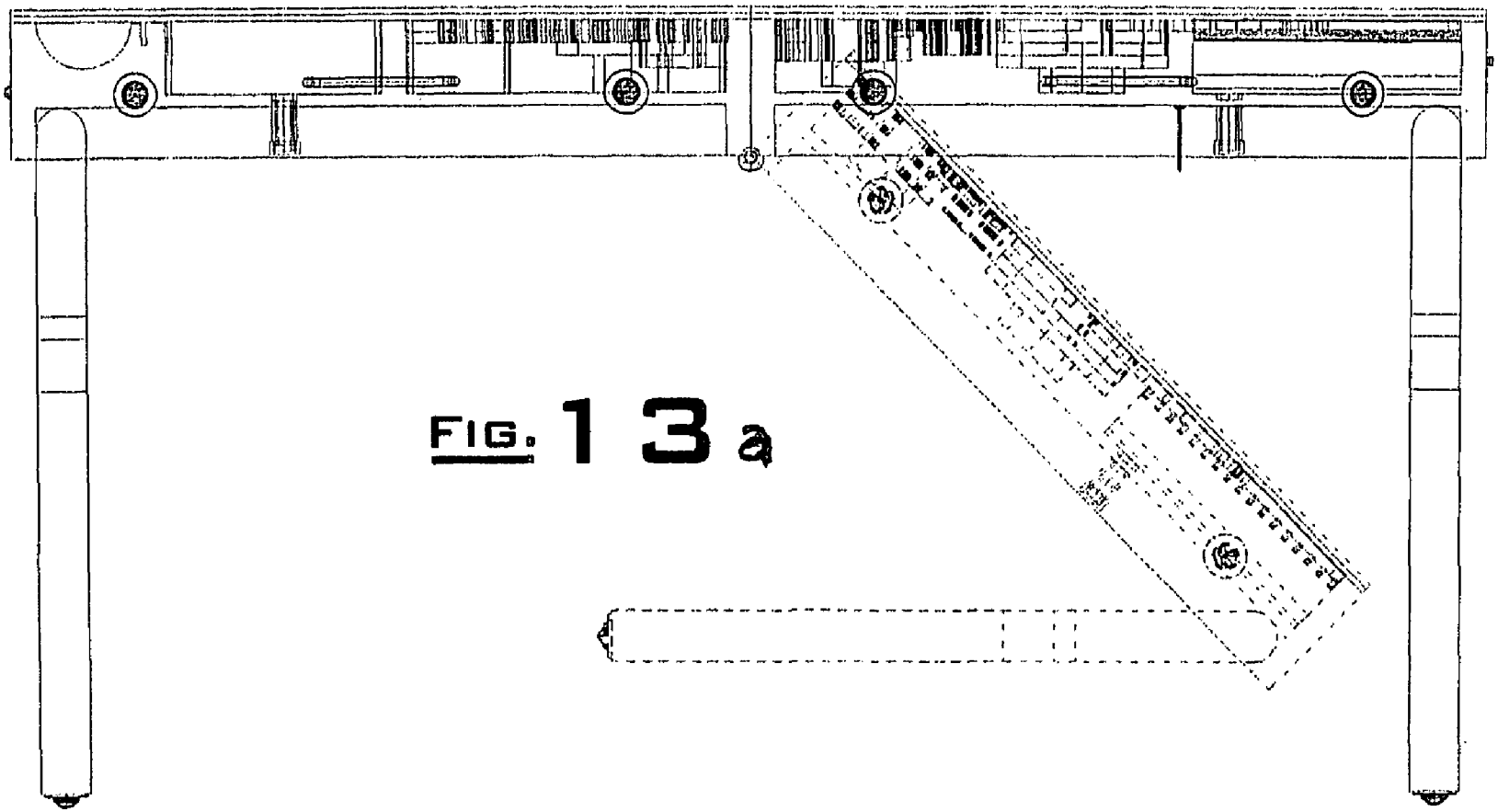

Referring to FIG. 13, FIG. 13 is a bottom view of an open, fully extended painter's table, portraying relative locations of paint reservoir drain holes 42, water reservoir drain hole 38, paint can double hook 44, two carrying case handles 22 mounted on a first set of adjacent sides of main body units 14 and 16, and four ball casters mounted on a second set of adjacent sides of main body units 14 and 16 opposite from the handles, and yet another four ball casters which are mounted on each leg-end of the two leg pairs (i.e., mounted on the opposite end of the leg from where the leg pairs mount to the main body units 14 and 16). FIG. 13 also shows a bottom view of hinge 18 that pivotally connects main body units 14 and 16 together. Latch hook 100 and latch pin 102 are shown at the extreme right and left ends of the painter's table as portrayed in FIG. 13. The latch hook 100 and latch pin 102 can be made to mate only after: first, the leg pairs 10 and 12 are pivotally retracted such that they come to a rest in a fully retracted position where the length of the leg pairs 10 and 12 are flush against the underside of the main body units 14 and 16; and second, where the undersides of main body units 14 and 16 themselves are brought flush against one another by pivotally moving the undersides of main body units 14 and 16 towards each other until they make contact with one another. It is at this point that latch hook 100 and latch pin 102 can been mated. Referring to FIG. 13*a*, FIG. 13*a* is a cross sectional drawing of the painter's table.

Figure 15:
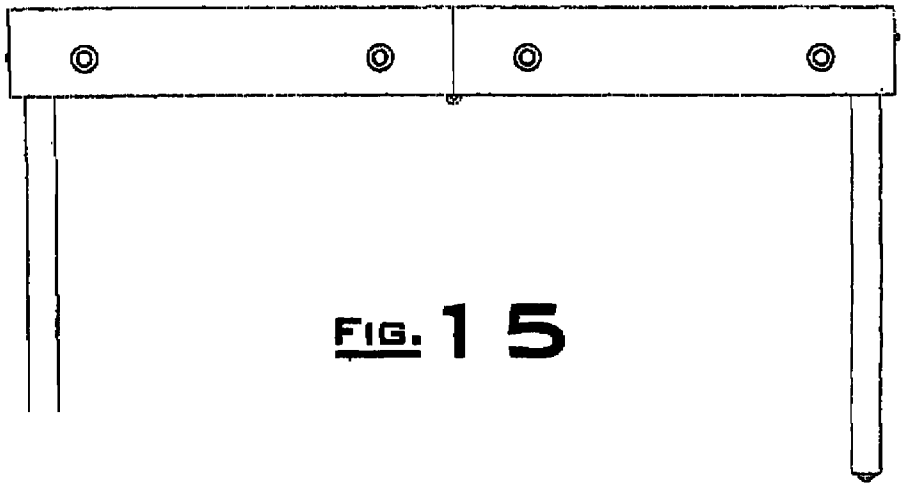
Figure 14:
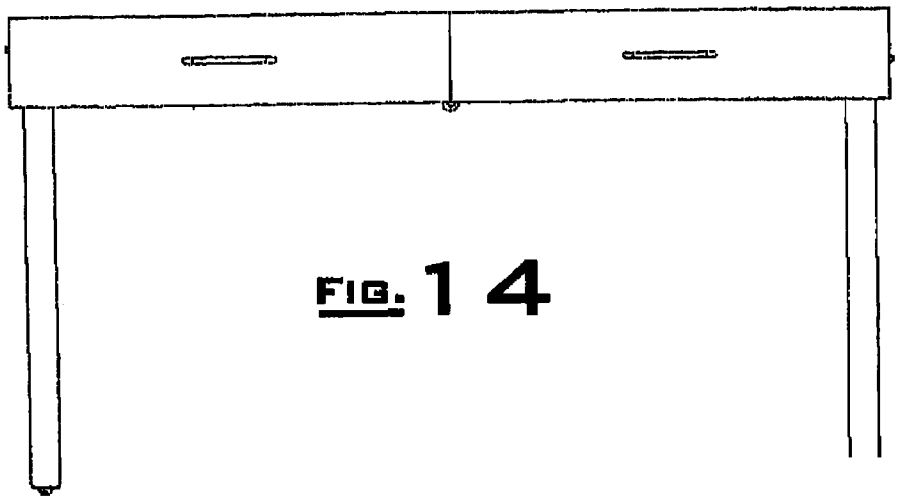

Referring to FIGS. 14 and 15, FIGS. 14 and 15 are viewed from perspectives that are 180 degrees out of phase relative to one another. FIGS. 14 and 15 are front and back side views of the painter's table when the table is in an open, fully extended position.

Figure 16:
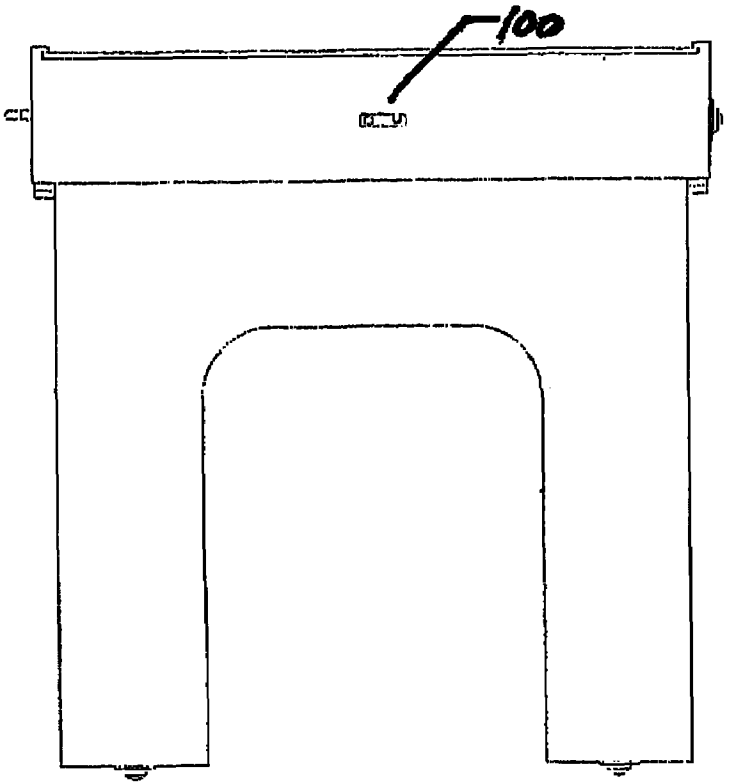

Referring to FIG. 16, FIG. 16 is an end view of the painter's table when the table is in an open, fully extended position. (i.e., FIG. 16 shows the end of main body unit 14 to which latch 100 is affixed—latch pin 102 is affixed to main body 16 on the opposite end of the table and is not shown in FIG. 16).

Figure 17:
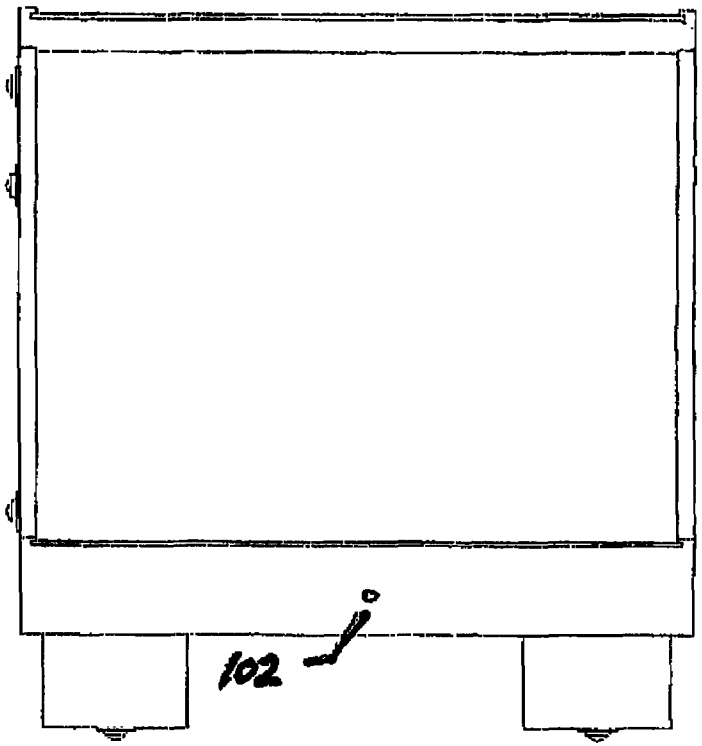

Referring to FIG. 17, FIG. 17 is viewed from the a perspective that is 180 degrees out of phase from the perspective of FIG. 16. FIG. 17 shows main body unit 16 to which latch pin 102 is affixed in a partially collapsed position with cover 24 installed in cover-channel furrows 20 (leg pair 12 is in fully retracted position, but is obscured from view by cover 24 and the end of the main body unit 16).

Figure 19:
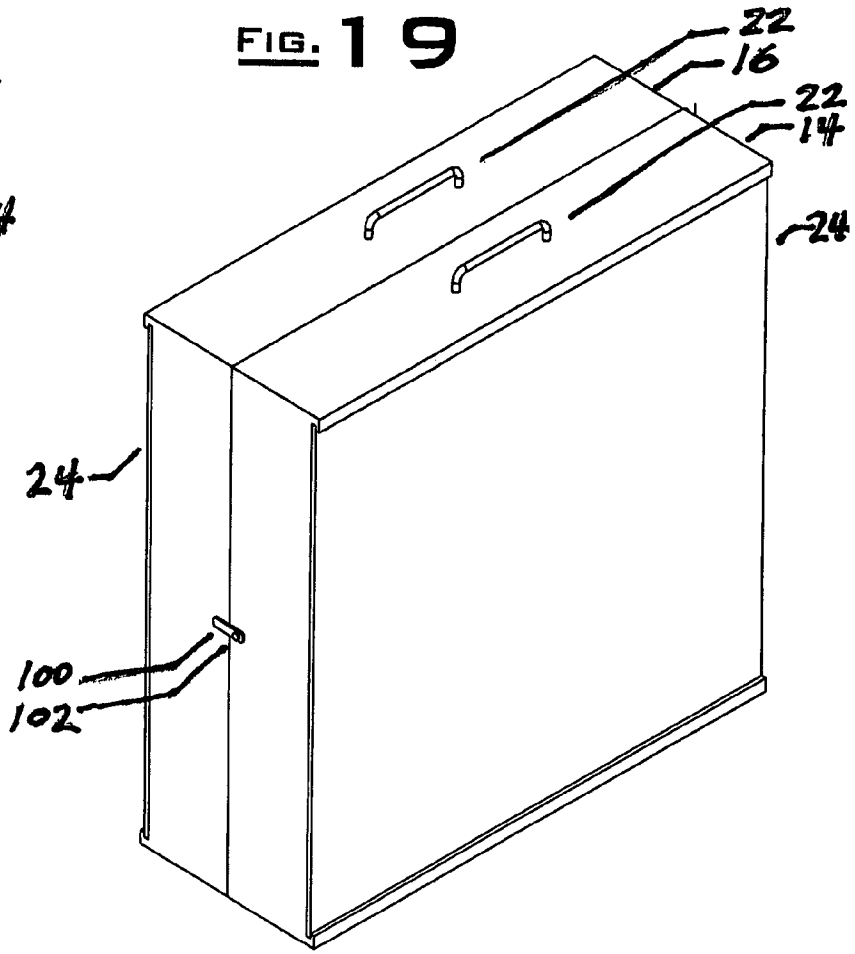
Figure 18:
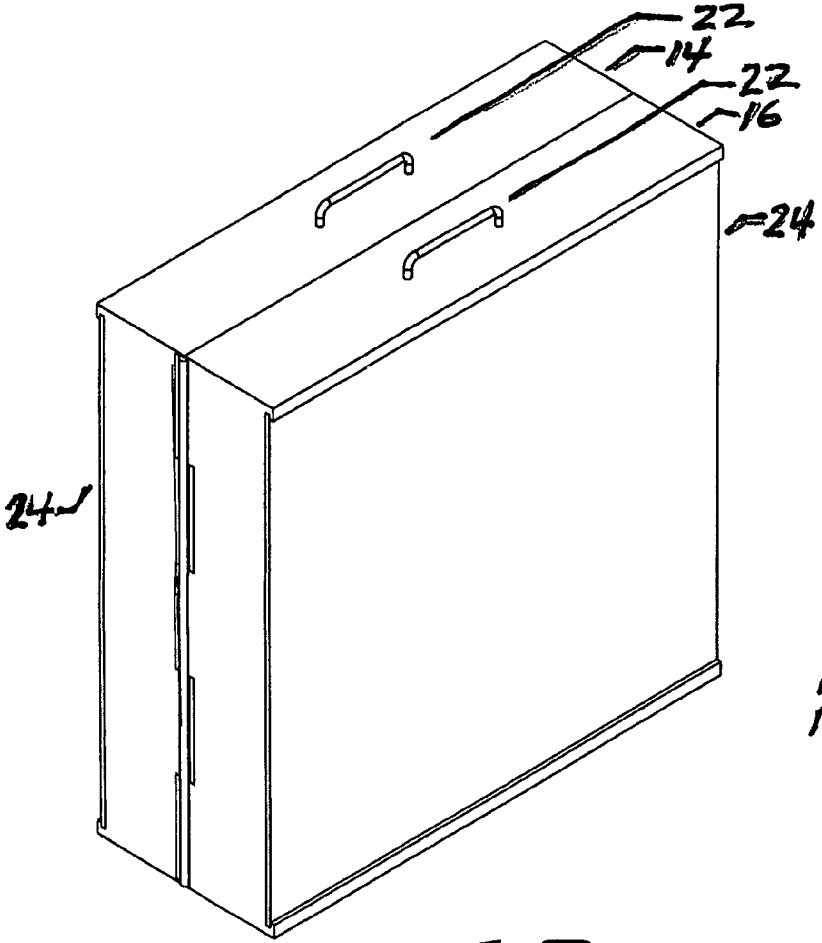

Referring to FIGS. 18 and 19, with covers 24 inserted into the grooves of main body units 14 and 16, FIGS. 18 and 19 show the invention in a completely collapsed, closed and latched carrying case configuration, ready for transport and storage. FIGS. 18 20 and 19 are viewed from perspectives that are 180 degrees out of phase relative to one another. FIGS. 18 and 19 detail the invention in its carrying case configuration with handles 22 mounted on a first set of adjacent sides of the main body units 14 and 16. And, although not shown in FIGS. 18 and 19, four ball casters are mounted on a second set of adjacent sides of the main body units 14 and 16.

There has thus been described a portable tool management, storage and organizational system for painting and wallpapering. While this invention has been described in terms of certain examples, however, it is not intended to be limited to the above description, but rather only to the extent set forth in the claims that follow.

What is claimed is:

1. A portable tool management, storage and organizational system for painting and wallpapering, comprising: first and second body members hingedly connected to each other by a hinge which lies along a first axis; the first and second body members being positionable in a first, open, position in which upper surfaces thereof face upwardly; the first and second upper surfaces of the first and second body members defining organization receptacles sized and shaped to receive painters' and/or wallpaperers' tools, the organizational receptacles being sized and shaped to correspond to shapes of various painters' and/or wallpaperers' tools such that when any such tool is placed in a corresponding receptacle of the system such tool is securely held and positively located relative to the body member which defines the receptacle one said receptacle being a roll dispenser receptacle, said roll dispenser receptacle including a cutter blade groove and a cutter straight edge positioned along a longitudinal edges of said roll dispenser receptacle, a second said receptacle being a water reservoir and including a drain hole and plug, said water reservoir positioned adjacent to and along said longitudinal edge of said roll dispenser receptacle, a first pair of legs hingedly connected to said first body member; a second pair of legs hingedly connected to said second body member; one or more cover panels slidably connected to the first and second body members, the cover panels being in close proximity to the organizational receptacles when the cover panels are fully connected such that the tools remain in their corresponding receptacle during transport of the system.

2. The portable tool management, storage and organizational system for painting and wallpapering of claim 1, wherein the first and second pair of legs are foldable into a closed position in which they are positioned adjacent undersides of the first and second body members, respectively, and the first and second body members are foldable into a second, closed, position in which the undersides thereof are facing each other and define a space there between in which the folded legs are disposed.

3. The portable tool management, storage and organizational system for painting and wallpapering of claim 1, further comprising a removable multi-compartment cleaning system tray insertable into said water reservoir receptacle.

4. The portable tool management, storage and organizational system for painting and wallpapering of claim 1, wherein at least one or more of said organization receptacles in the first or second body member is a paint reservoir.

5. The portable tool management, storage and organizational system for painting and wallpapering of claim 4, further comprising at least one paint compartment dividers inserted into said paint reservoir.

6. The portable tool management, storage and organizational system for painting and wallpapering of claim 1, wherein at least one of the organization receptacles in the first or second body member is a multi-compartmental paint reservoir.

7. The portable tool management, storage and organizational system for painting and wallpapering of claims 4 or 6, wherein said paint reservoir of the organization receptacles in the first or second body member includes a reservoir drain hole, and a reservoir drain hole plug removably connectable to the reservoir drain hole.

8. The portable tool management, storage and organizational system for painting and wallpapering of claim 7, further comprising a hook connected to the underside of the first or second body member in close proximity to the at least one of the reservoir drain holes.

9. The portable tool management, storage and organizational system for painting and wallpapering of claim 1, further comprising a three-tiered paint receptacle compartment designed to accommodate square gallon, round gallon and round quart paint cans.

10. The portable tool management, storage and organizational system for painting and wallpapering of claim 1, wherein at least one of the receptacles in the first or second body member is a receptacle for securing a roll of painters tape.

11. The portable tool management, storage and organizational system for painting and wallpapering of claim 10, further comprising a raised spindle column in the tape roll receptacle for centering and securing a roll of painters tape.

12. The portable tool management, storage and organizational system for painting and wallpapering of claim 1, further comprising a caster on the end of each leg.

13. The portable tool management, storage and organizational system for painting and wallpapering of claim 1, further comprising a plurality of casters and handles mounted on opposing exterior side surfaces of the first and second body members so that the portable tool management, storage and organizational system for painting and wallpapering can be carried or rolled a surface when in a closed position.

* * * * *